United States Patent [19]

Tashiro

[11] 4,033,082

[45] July 5, 1977

[54] PLATE BLOCK

[75] Inventor: Eiji Tashiro, Hoya, Japan

[73] Assignee: Tokyo Plywood Kabushiki Kaisha, Tokyo, Japan

[22] Filed: July 31, 1975

[21] Appl. No.: 600,765

[30] Foreign Application Priority Data

Aug. 12, 1974 Japan ..... 49-92150

[52] U.S. Cl. ..... 52/316; 52/505; 52/586; 52/592; 428/81; 428/151

[51] Int. Cl.[2] ..... E04C 1/00

[58] Field of Search ..... 52/311, 313, 589, 592, 52/586, 613, 615, 664, 316, 505, 483, 622, 314; 428/81, 151

[56] References Cited

UNITED STATES PATENTS

| | | | |
|---|---|---|---|
| 2,045,312 | 6/1936 | Roos et al. | 52/506 |
| 2,129,441 | 9/1938 | Otto | 52/615 |
| 2,276,071 | 3/1942 | Scull | 52/592 |
| 2,381,469 | 8/1945 | Sweet | 52/483 |
| 3,204,380 | 9/1965 | Smith | 52/592 |
| 3,415,708 | 12/1968 | Rondum | 52/613 |
| 3,820,293 | 6/1974 | Ohe | 52/586 |

*Primary Examiner*—Alfred C. Perham
*Attorney, Agent, or Firm*—Frank J. Jordan

[57] ABSTRACT

A plate block includes a decorative plate which includes a substratum and a face veneer joined to the substratum by adhesive means. The substratum has a front face and a rear face with inclined edge portions disposed between the front face and the rear face such that the rear face is larger than the front face. The face veneer is joined to the front face and to the edge portions. A base plate is disposed in spaced parallel relationship relative to the decorative plate, and an intermediate member is disposed between the base plate and the decorative plate with the base plate having at least one edge portion projecting beyond an edge of the decorative plate to facilitate assembly of a plurality of plate blocks in juxtaposed array.

2 Claims, 10 Drawing Figures

PLATE BLOCK

BACKGROUND OF THE INVENTION

The present invention relates to plate blocks for decorating wall faces and includes the use of base plates which are fixed in parallel but in a shifted position by means of intermediate members on the back face of substantially equally large substratum having a face veneer glued and fixed integratedly on the surface and side surface, thereof.

On plate blocks for decorating wall faces used in the building structures, study has hitherto been made on preventing cracks and ripples on the thin face veneer which is glued to form the surface. In the conventional process, however, decorative coating is applied on the surface and only one side face of a substratum such as plywood and particle board but is not provided integrally on the other surface. For example, in the case of a face veneer joined to a planar article with glue, the veneer can be joined integrally to either one side of the planar article surface, but not joined to the other side surface. Accordingly, a face veneer as large as the unjoined side face must be prepared on the other hand and then joined to the side face, requiring several sheets of face veneers. Not only is the process complicated and requires care in working, but also there is the greater possibility of separation of the face veneer during handling or transportation and even after finish working. Moreover, the product cannot provide agreement in the pattern of the face veneer, or the cross grain does not coincide in the joint with the straight grain in natural wood, thus spoiling the pattern or appearance. Further, such block product as thus obtained is not easy to firmly fix into the structure, pillars, or wall face thereof. To cite an example, even if such block product is glued in the wall face, such joint becomes brittle due to the variation of temperature and humidity. Accordingly, such blocks may separate from the wall or, in case the blocks are bored and fastened with pins, the desired decorative effect will not be obtained.

SUMMARY OF THE INVENTION

In view of the above-mentioned fact, the present improvement intends to improve the unfavorable structure of such conventional block type of face veneer. According to the present invention all the surfaces including all surfaces of the surface and slide faces of a square, polygonal, or symmetrical planar substratum are glued and fixed integrally with a thin face veneer, thereby eliminating the drawback found in the conventional block. At the same time, a substantially equally large base plate is fixed in parallel but shifted relatively by means of an intermediate member. By so doing, the block may be easily fixed on a pillar and wall, and the presence of vacant space formed by the intermediate member helps to control temperature and humidity while improving sound insulation. And the planar article forming the substratum may be a wooden plate, plywood, particle board, hard board, asbestos cement, pulp cement plate, etc. On the surface of this planar article is glued directly a thin face veneer, or a face veneer lined with such material as fabrics, paper, or felt-like sheet which is pressed and glued with adhesive material.

DESCRIPTION OF THE PREFERRED EMBODIMENTS

Figure 1:
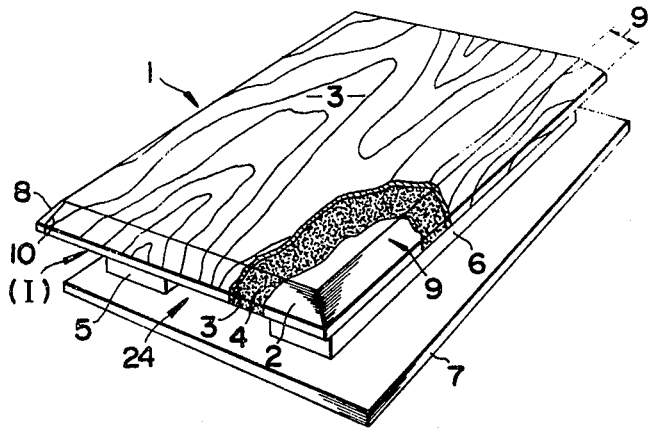
FIG. 1 is a partly cutaway perspective view of a plate block having a face veneer glued thereto according to one embodiment of the present invention.
Figure 2:
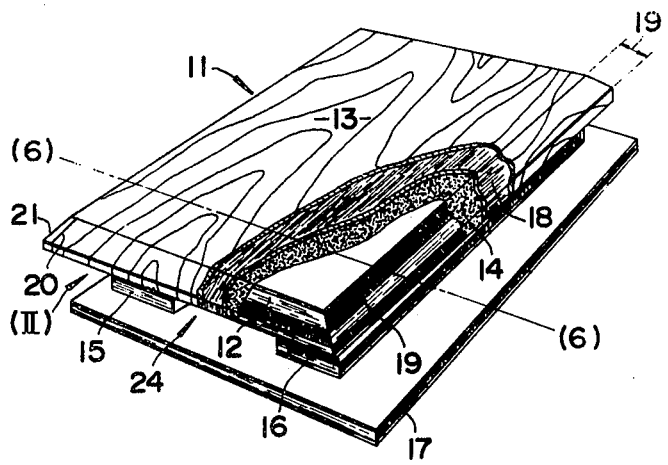
FIG. 2 is a partly cutaway perspective view of a plate block having a lined face veneer according to a second embodiment.
Figure 3:
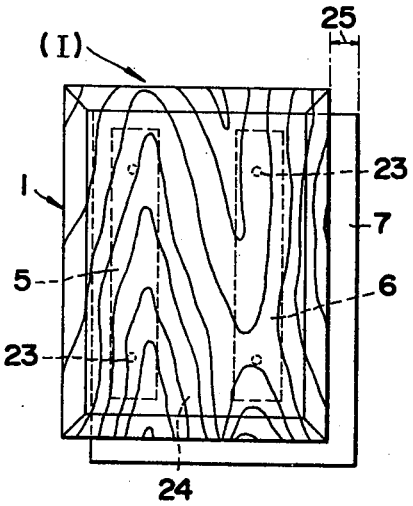
FIG. 3 is a plan view of the plate block shown in FIG. 1.
Figure 4:
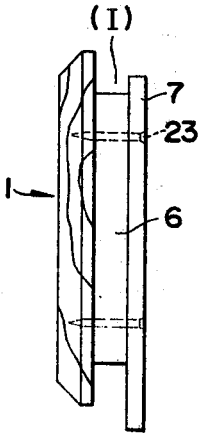
FIG. 4 is a side view of FIG. 3.
Figure 5:
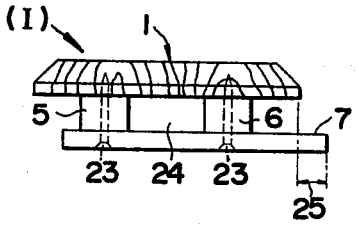
FIG. 5 is a front view of FIG. 3.
Figure 6:
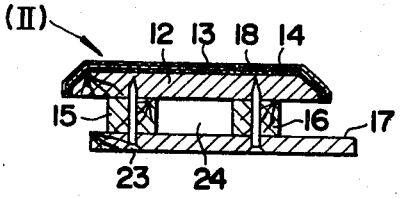
FIG. 6 is a cross-sectional view taken along line (6)—(6) of FIG. 2.

In the following, several embodiments of the present invention will be described. FIGS. 1 and 2 are pictorial drawings, partly cutaway, of a plate block according to a first and second embodiment of the present invention. FIG. 1 shows the first embodiment in which a face veneer 3 is joined with an adhesive 4 directly on a substratum 2 in the form of a planar article. FIG. 2 shows a second embodiment in which a lined face veneer 13 is used. Both the substratum 2 which is a wooden plate in FIG. 1 and the substratum 12 which is made of plywood in FIG. 2 are shown square, but the substratum may take on other forms as described above. However, in any case, its peripheral side edge is larger in its back face than in the front face and the two faces are similar in shape, such that inclined edges 9 and 19 joining the front and back faces form trapezoids. The degree of inclination of the peripheral inclined 9, 19 is properly from 20° to 70 °. In FIGS. 1 and 2, the whole surface of the substrata 2 and 12 and of the peripheral edges 9 and 19 are each coated with an adhesive agent 4 and 14. The adhesive agent may be of the thermosetting type, thermoplastic type, or a mixture of the two adhesive agents, in consideration of the desired adhesive strength. In the embodiment of FIG. 1, a face veneer 3 is placed directly on the surface of the substratum 2 which is coated with adhesive agent 4. In the embodiment of FIG. 2, the face veneer 13 is provided with a lining material 18 which is so placed as to make the lining side contact with the substratum 12. Lining is provided partly or all over the face as desired. The thickness of the face veneer is about from 0.1 to 0.5 mm in either case. The size of the thin face veneer 3, 13 is preferably substantially similar to the total of the surface of the substrata 2 and 12 respectively and the area of the peripheral inclined size faces 9, 19 thereof, and may be slightly larger than the size of the substrata 2 is disposed on the 12. The face veneer and substratum so that the centers and the holes coincide with each other respectively. In this connection, it is recommended depending on the shape of the substratum to provide a slender wedge-form notch 10 or 20 in the direction of the straight grain near a bent portion 8 or 21 of the face veneer. By providing such a notch, the peripheral edge of the face veneer may be adapted easily to the inclined face of the substratum, thereby establishing the coating effect to such an extent that the butt joint is hardly noticed from outside.

The substratum joined with the face veneer as described above is firmly fixed by means of a pressing or pressure reducing device not shown in the drawing. In the case of a pressure reducing device, the substratum and the face veneer are covered all over with an elastic envelop made of rubber or synthetic resin sheet and fixed to a box frame, thus covering the periphery tightly. The, pressure inside of the box frame is then reduced by a suction device so as to reduce the pressure between the elastic envelop and the face veneer and thereby draw or suck in the elastic envelop, the envelop thus contacting closely with the whole surface of the face veneer. In case the negative pressure further reaches 6–10 Kg, the face veneer is joined integrally on the surface of the substratum and the right and left inclined faces, tightly joining the substratum and inclined faces with adhesive agent by the pressing of the envelop. During the process of this pressure reducing operation, heating of the air outside and inside the envelope with steam or heating equipment to 100° – 120° C. is very effective. When glued sufficiently, the substratum is firmly fixed with the bent portions, projections, and recesses covered closely to fit its shape. Then air is introduced to release the envelope and the working operation is completed. The decorative plate I or II is obtained as shown in FIGS. 1 and 2 respectively.

On the back face of the decorative plate I or II there is fixed in parallel relationship a substantially equally large base plate 7 or 17 by means of intermediate members 5, 6, or 15, 16 respectively. The manner of this fixing is such that, first by offsetting in one direction longitudinally or laterally or by shifting in two directions longitudinally and laterally at right angles to each other, an offset portion 25 is fixed to protrude outwardly from the side edge of the face veneer 1 or 11. The form of the intermediate member may be arbitrarily selected, but planar and rectangular members as shown in the drawing are preferred; however, care must be exercised so as to leave a space 24 in the middle portion when a plurality of such members are fixed by an adhesive agent or pins 23. The material for the intermediate member and base plate may be ordinary wooden plate or plywood. The plate block (I) or (II) according to the present invention is thus obtained.

Figure 7:
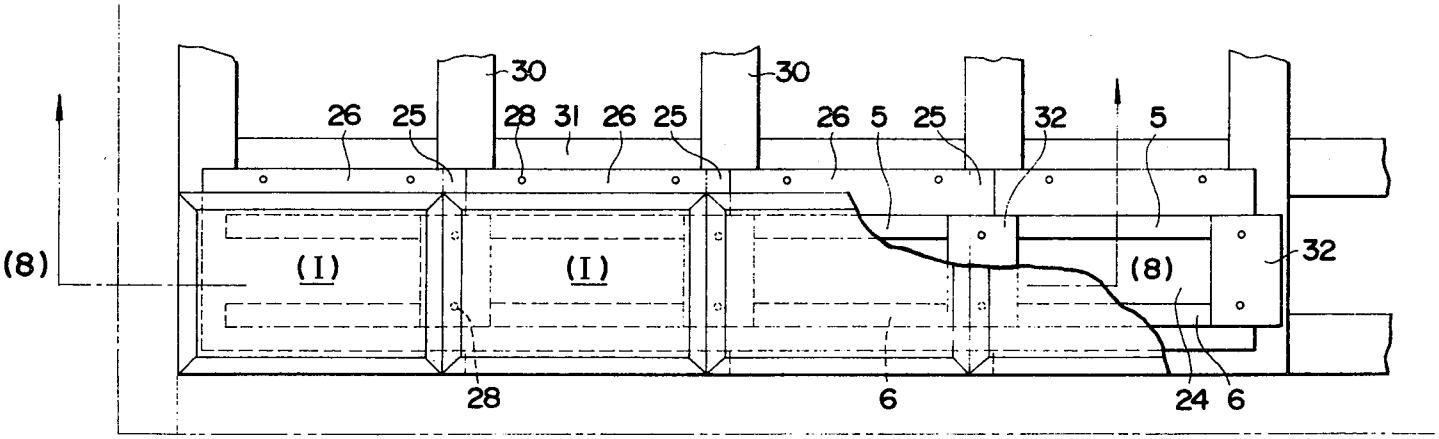
FIG. 7 is a partial front view of a practical construction combining the plate blocks of FIG. 1 horizontally.
Figure 8:
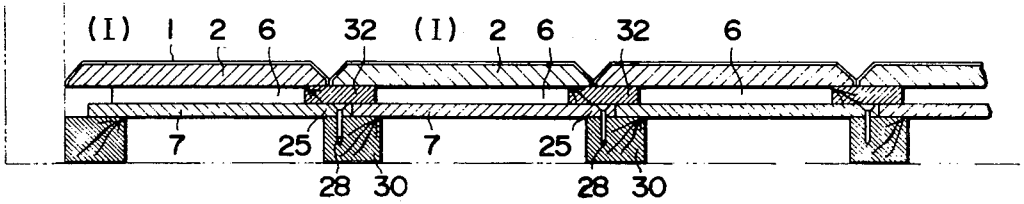
FIG. 8 is a cross-sectional view taken along line (8)—(8) of FIG. 7.
Figure 9:
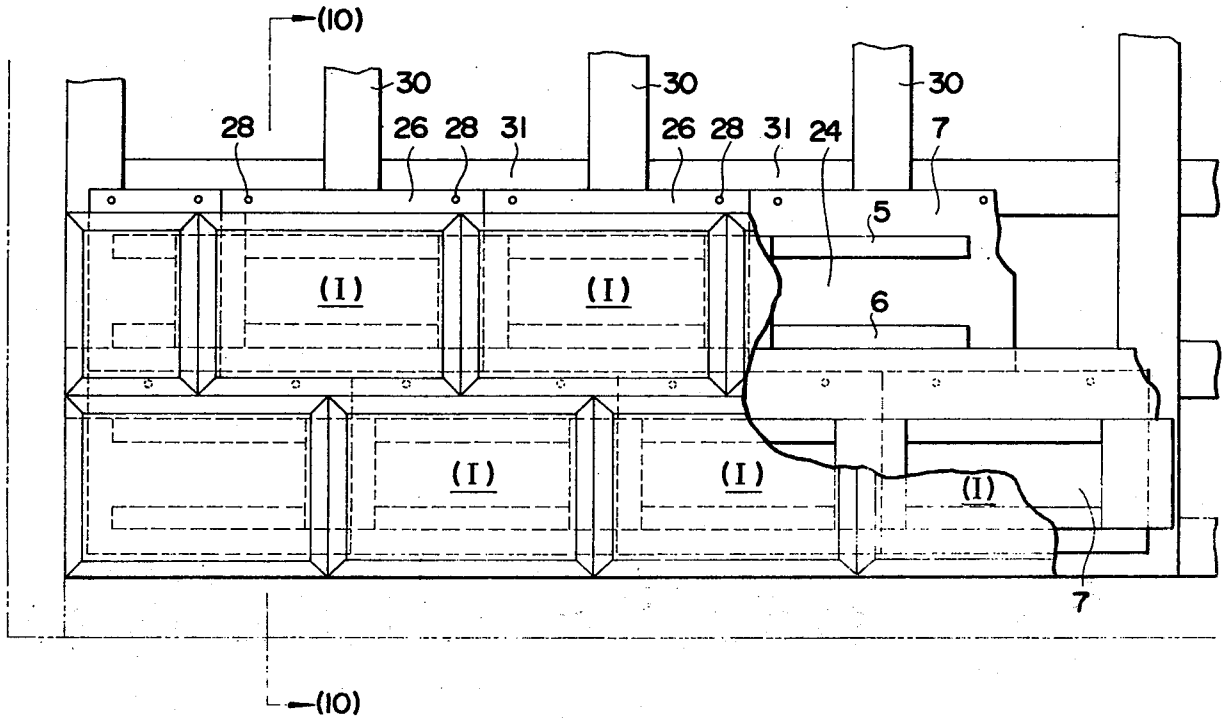
FIG. 9 is a partial front view of a practical construction combining the blocks FIG. 1 horizontally and vertically.
Figure 10:
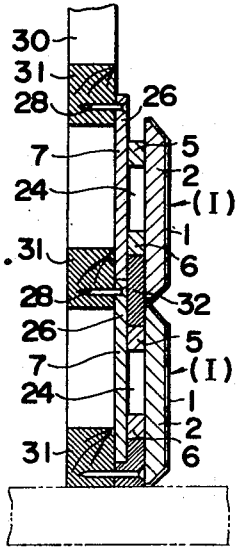
FIG. 10 is a cross-sectional view taken along line (10)—(10) of FIG. 9.

FIGS. 7, 8, 9, and 10 show practical cases in which the plate blocks provided as described above according to the present invention are combined and fixed continuously to beam, frames, pillars, and walls. An explanation will be given of the plate block (I) shown in FIG. 1. However, the following explanation will also apply in the same manner as regards plate block (II). Also the blocks (I) and (II) may be combined and used in some cases. FIGS. 7 and 8 illustrate an arrangement in which the blocks are disposed horizontally: and wherein the base plate 7 of a plate block (I) is disposed on a pillar 30 in an upright position at regular intervals, and firmly fixed by a holder or fastening element such as a nail, pin, or screw with the edge of the offset portion 25 located at approximately the middle portion of the pillar 30. Then, the base plate of another plate block (I) is placed between the pillar 30 and an adjacent pillar, and an intervening member 32 is inserted into the middle portion between the two blocks. In the same manner as above, the offset portion of the base plate is firmly fixed to the pillar with a fastening element or holder, and the connection is continued successively. FIGS. 9 and 10 illustrate a case in which the blocks are combined in vertical disposition. This is the same with the above-mentioned case in that the offset portion 26 of the base plate 7 is firmly fixed to a vertical pillar or beam 31 by a holder or fastening element 28. When another block is to be connected, an intervening member 32 is inserted thereafter repeating the connection successively for fixing the blocks.

The plate block arrangement according to the present invention is effected as described above. In case of practicing the invention as shown in FIGS. 7 – 10, the protruding portions 25 and 26 with the base plates 7 and 17 offset are convenient to fix by driving the holder or fastening element or by screwing into the pillar or beam. This makes the practicing easy and advantageous. Inside the connected plate blocks, connected spaces are formed by the intermediate members 5 and 6, thereby providing for circulating air to control temperature and humidity and also producing sound insulation effects. Further, in the present invention, the substratum 1 is not limited to plywood as described above. For example lightweight plates, non-combustible plates, or other plates may be selected and the surface of such plates are coated with face veneer so as to provide a good appearance, therefore making them suitable for interior decoration. Particularly, the face veneer on the surface covers the substratum surface by only one sheet, and the straight grain covers over all of the surface, thereby preventing the occurrence of cracks. Since the face veneer is a thin sheet, long time use is possible with hard wood. Expensive wood is limited in volume but may therefore be provided at lower cost according to the present invention.

What is claimed is:

1. A plate block comprising a decorative sheet, said decorative sheet comprising a substratum and a single face veneer sheet, said substratum having a front face and a rear face, said front face being smaller than said rear face such that beveled edge portions are formed on said substratum between said front and rear faces, said beveled edge portions extending about the entire periphery of said substratum, said beveled edge portions of said substratum being inclined from twenty to seventy degrees relative to said front and rear faces thereof, said single face veneer sheet having an overall area at least equal to the sum of the area of said front face of said substratum and the total area of said beveled edge portions of said substratum, said single face veneer sheet having peripheral edge portions, said single face veneer sheet being bent to conform to said beveled edge portions of said substratum with the bent section of said single face veneer sheet having means defining a notched section of facilitate adapting the single face veneer sheet to an abutting relationship with said beveled edge portions of said substratum, said single face veneer sheet being joined by adhesive means to said front face and to said beveled edge portions of said substratum, a base plate disposed in spaced parallel relationship relative to the rear face of said decorative plate, at least one intermediate member disposed between said base plate and said decorative plate, a first edge portion of said base plate projecting beyond a first edge portion of said decorative plate and a second edge portion of said decorative plate opposite said first edge portion thereof projecting beyond a second edge portion of said base plate, said second edge portion of said base plate being opposite said first edge portion thereof, said first edge portion of said base plate facilitating assembly of a plurality of plate blocks in juxtaposed and abutting array in that the first edge portion of the base plate of one plate block is adapted to abut the second edge portion of the base plate of another juxtaposed plate block and the first edge portion of the decorative plate of said one plate block is adapted to abut the second edge portion of the decorative plate of said other juxtaposed plate block, said projecting first edge portion of said base plate being readily accessible to have fastening means applied thereto for attaching said one plate block to a beam element or the like prior to placing said other plate block in said juxtaposed and abutting position.

2. A building construction using the plate blocks of claim 1, said building construction comprising a plurality of said plate blocks disposed in juxtaposed array and an intervening member disposed between juxtaposed plate blocks in the space between the decorative plates and base plates thereof.

* * * * *